US007686405B2

(12) United States Patent
Trulaske, Sr. et al.

(10) Patent No.: US 7,686,405 B2
(45) Date of Patent: Mar. 30, 2010

(54) SELF-CLOSING SLIDING DOOR ASSEMBLY

(75) Inventors: Steven L. Trulaske, Sr., St. Louis, MO (US); Robert J. Trulaske, Jr., St. Louis, MO (US)

(73) Assignee: True Manufacturing Co., Inc., O'Fallon, MO (US)

( * ) Notice: Subject to any disclaimer, the term of this patent is extended or adjusted under 35 U.S.C. 154(b) by 688 days.

(21) Appl. No.: 11/110,558

(22) Filed: Apr. 20, 2005

(65) Prior Publication Data

US 2008/0007148 A1 Jan. 10, 2008

(51) Int. Cl.
*A47B 88/00* (2006.01)

(52) U.S. Cl. ..... 312/304; 312/319.4; 49/404; 16/81

(58) Field of Classification Search ..... 312/304, 312/319.4; 49/404; 160/188; 16/81
See application file for complete search history.

(56) References Cited

U.S. PATENT DOCUMENTS

| | | | | | |
|---|---|---|---|---|---|
| 180,583 | A | | 8/1876 | Higinbotham | |
| 209,966 | A | | 11/1878 | Gates | |
| 240,567 | A | * | 4/1881 | Wright | 16/81 |
| 516,802 | A | | 3/1894 | Eddy | |
| 604,716 | A | | 5/1898 | Breed | |
| 617,159 | A | * | 1/1899 | Hogan et al | 16/81 |
| 914,817 | A | | 3/1909 | Filson | |
| 1,167,267 | A | | 1/1916 | Bujewski | |
| 2,057,975 | A | * | 10/1936 | Plym | 49/458 |
| 2,112,347 | A | | 3/1938 | Ross | |
| 2,551,032 | A | | 5/1951 | McDonald | |
| 3,328,105 | A | | 6/1967 | Trulaske | |
| 3,334,444 | A | | 8/1967 | Hargrove | |
| 3,760,535 | A | | 9/1973 | Trulaske | |
| 3,978,617 | A | * | 9/1976 | Eventoff | 49/404 |
| 4,003,102 | A | | 1/1977 | Hawks et al. | |
| 4,126,912 | A | | 11/1978 | Johnson | |
| 4,357,732 | A | | 11/1982 | Hickman | |
| 4,471,575 | A | | 9/1984 | Stout | |
| 4,649,598 | A | | 3/1987 | Kinsey et al. | |
| 4,665,584 | A | | 5/1987 | Williams | |
| 4,884,369 | A | | 12/1989 | Tatham | |
| 4,891,911 | A | | 1/1990 | Yung | |
| 5,131,188 | A | | 7/1992 | Hutchison et al. | |
| 5,579,607 | A | | 12/1996 | Braid | |

(Continued)

FOREIGN PATENT DOCUMENTS

| | | | | |
|---|---|---|---|---|
| DE | 3343774 | * | 6/1985 | 49/404 |

*Primary Examiner*—Hanh V Tran
(74) *Attorney, Agent, or Firm*—Polster Lieder Woodruff & Lucchesi LC

(57) ABSTRACT

This self-closing, sliding door assembly is used for a cabinet having a front opening and a pair of doors each mounted for movement in upper and lower tracks. A counterweight is attached to each door by a sash-line having a vertical length attached to the counterweight and a horizontal length attached to an associated door. The sash-line is guided from the vertical to the horizontal by a pair of pulley bracket assemblies one being mounted to a cabinet wall in a vertical plane and the other being mounted to a cabinet wall in a horizontal plane. The sash-line is retained on the pulleys by the pulley brackets during movement of the counterweight to guard against slip off the pulleys.

5 Claims, 3 Drawing Sheets

U.S. PATENT DOCUMENTS 5,850,672 A 12/1998 Dalton
6,065,184 A 5/2000 Drury
6,142,260 A 11/2000 Shin
6,968,645 B2 * 11/2005 Epps et al. ..... 49/123

* cited by examiner

SELF-CLOSING SLIDING DOOR ASSEMBLY

BACKGROUND OF THE INVENTION

This invention relates generally to a sliding door assembly for a cabinet and particularly to an assembly which can be used for glass fronted display cabinets for beverages, food products and the like.

In the prior art and, for example, in a patent owned by the assignee of the present application, namely, U.S. Pat. No. 3,328,106 Self-Closing Cabinet Doors are known. This particular patent, utilizes an offset counterweight system having a double bent guide tube which directs the sash-line through two 90° turns.

As pointed out in U.S. Pat. No. 3,328,106 the use of pulleys had not proved successful because the sash-line tends to slip off the pulleys, which was a problem solved by the use of a double bent guide tube. On the other hand, the guide tube does not have the relatively frictionless free motion of a pulley system such as a ball bearing pulley system.

The present invention overcomes the disadvantages of the known prior art systems.

SUMMARY OF THE INVENTION

The present sliding door system overcomes the disadvantages of the prior art sliding door systems by providing a free motion pulley arrangement, which uses an effective guidance system to essentially eliminate sash-line slip off the pulleys.

The self-closing sliding door assembly is intended primarily, but not exclusively, for use in conjunction with an open front cabinet and includes at least one door slidably mounted for movement in a plane between an open and closed position. The system includes a counterweight offset from the plane of the door to overcome resistance to motion. A first pulley mounted for rotation in a horizontal plane and a second pulley mounted for rotation in a vertical plane. A sash-line is provided having opposed ends one of which is attached to the door and the other of which is attached to the counterweight. Guide means are provided for guiding and retaining the sash-line on the pulleys during movement of the door and counterweight.

It is an aspect of this invention to provide that each pulley is mounted to a bracket and the bracket provides the guiding and retaining means.

It is another aspect of this invention that the door can be used for double door closure purposes.

This self-closing, sliding door assembly is relatively simple to manufacture and install and is very effective for it intended purpose.

DESCRIPTION OF THE PREFERRED EMBODIMENT

Figure 1:
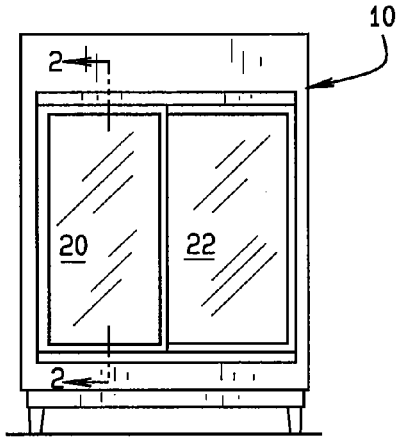
FIG. 1 is a front elevational view of a self-closing sliding door, glass fronted merchandiser.
Figure 3:
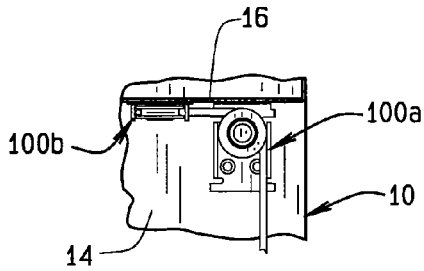
FIG. 3 is a fragmentary cross-sectional view taken along line 3-3 of FIG. 2 illustrating a corner of the merchandiser.

Referring now by reference numerals to the drawings and first to FIGS. 1-4 it will be understood that the self-closing sliding door assembly is suitable for beverage merchandisers, display cabinets and storage cabinets. In the embodiment shown, the cabinet, generally indicated by numeral 10 in FIG. 1 has an opening defined by a ceiling wall 12 a floor wall 14 and a pair of laterally opposed sidewalls 16 and 18. A pair of movably mounted sliding doors 20 and 22 are slidably mounted to provide a closure for the opening of the cabinet 10 as will now be described.

Mounted on the cabinet floor wall 14 is an elongate double-channel guide track 24 which extends substantially between the end sidewalls 16 and 18. Each of the side-by-side channels 26 and 28 of the lower track 24 receives sliding doors 20 or 22, respectively, in movable relation. A similar elongate double channel track 30, having side-by-side channels 32 and 34, is mounted to the ceiling wall 12 in vertically aligned relation to the double channel of the floor wall 14 to receive and stabilize the sliding doors. In effect, the lower track 24 guides the bottom of the doors in sliding relation as by rollers. The upper track 30 guides the top of the doors by overlapping of the doors, as shown in FIG. 5, by the side flanges of the side channels 32 and 34.

Figure 5:
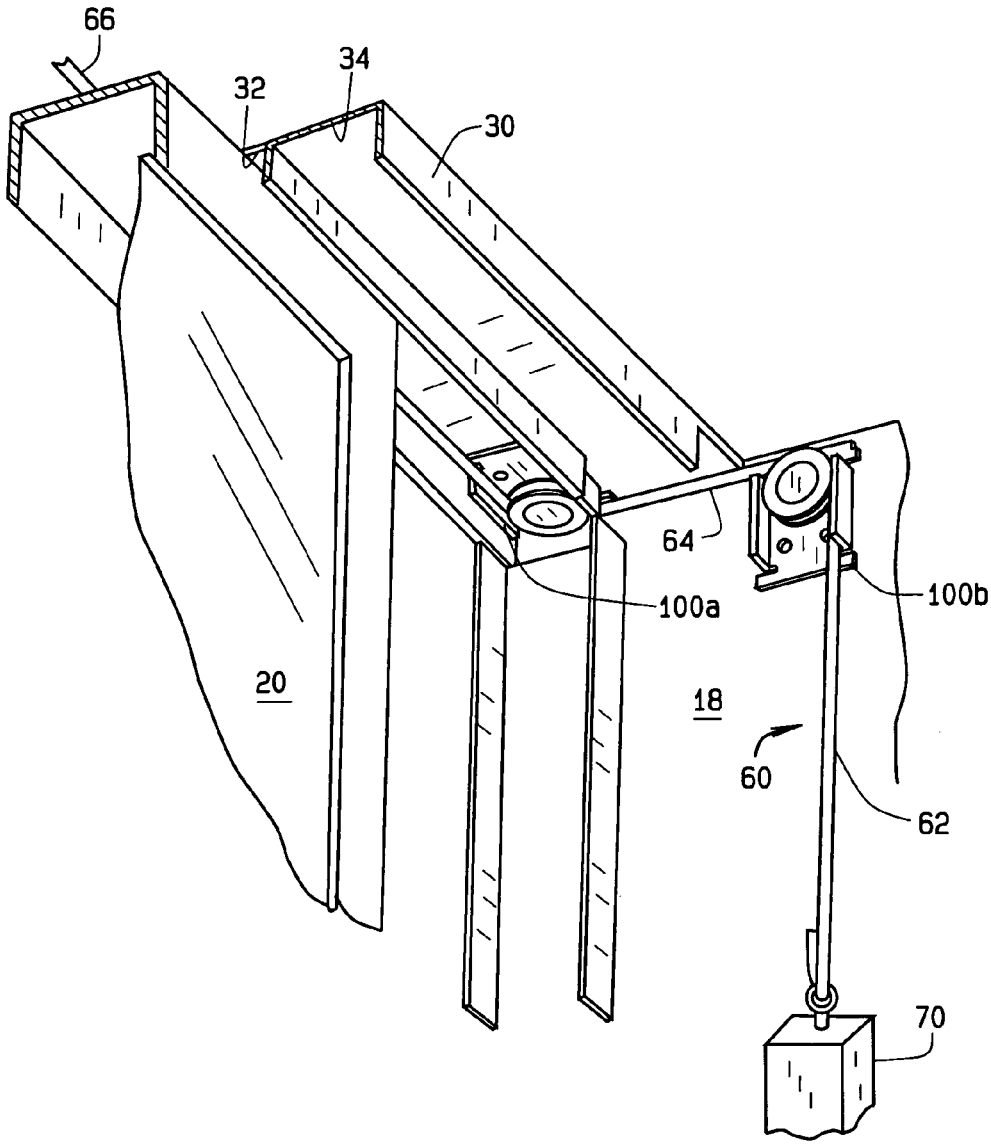
FIG. 5 is an enlarged fragmentary perspective view taken from the inside of the merchandiser, showing the pulley bracket and sash-line arrangement.
Figure 6:
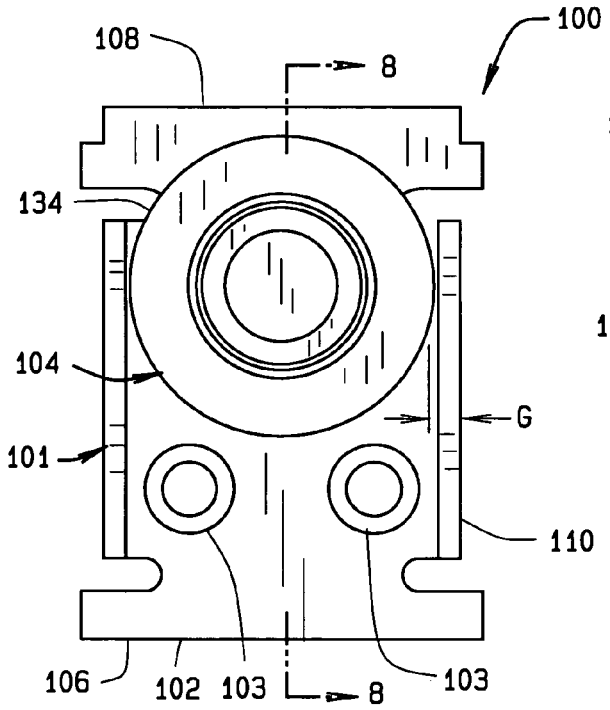
FIG. 6 is an elevational view of a pulley bracket.
Figure 7:
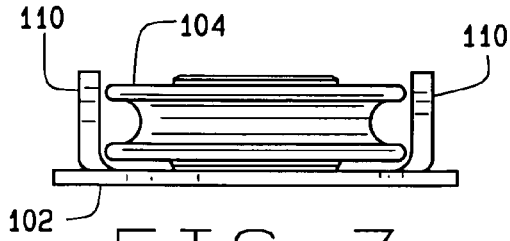
FIG. 7 is a plan view thereof.

As shown in FIG. 5, read in conjunction with FIGS. 6-9, two sets of pulley bracket assemblies 100 are provided to guide a sash-line 60. The two sets are identical except that the first set, designated 100*a*, is mounted in the horizontal plane in the upper guide channel 30 and the second set 100*b* is mounted in the vertical plane directly to the cabinet sidewall 18. It will be understood that the axis of rotation of the pulley assembly 100*a* is vertical while the axis of rotation of the pulley assembly 100*b* is horizontal and disposed at 90° to the axis of rotation of the pulley assembly 100*b*. The sash-line 60 has a vertical portion 62 attached to a counterweight 70 by an eyebolt; a first horizontal portion 64 extending between the two pulley systems 100*a* and 100*b*; and a second horizontal portion extending from pulley system 100*a* to a remote connection point on the door 20 as by a screw.

The pulley systems 100*a* and 100*b* are provided with an arrangement of parts such that the sash-line 60 is guided over the pulleys and effectively retained on the associated pulleys by virtue of a guard arrangement, as will now be described.

The pulley bracket assembly 100 is best shown by reference to FIGS. 6-9 and includes a bracket 101 and a pulley 104. the bracket includes a base plate 102 cut and shaped to form a rear portion 105, upper and lower portions 106 and 108 and slotted side flanges 110, for mounting the pulley.

Figure 8:
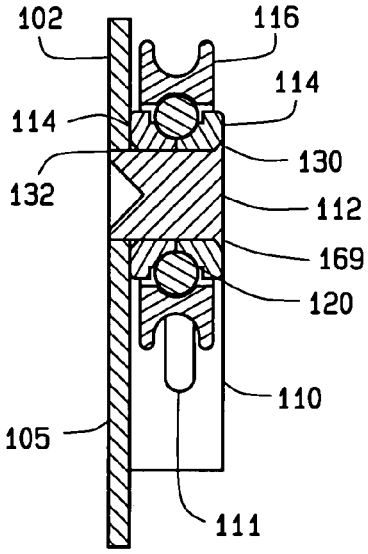
FIG. 8 is a cross-sectional view taken on line 8-8 of FIG. 6.
Figure 9:
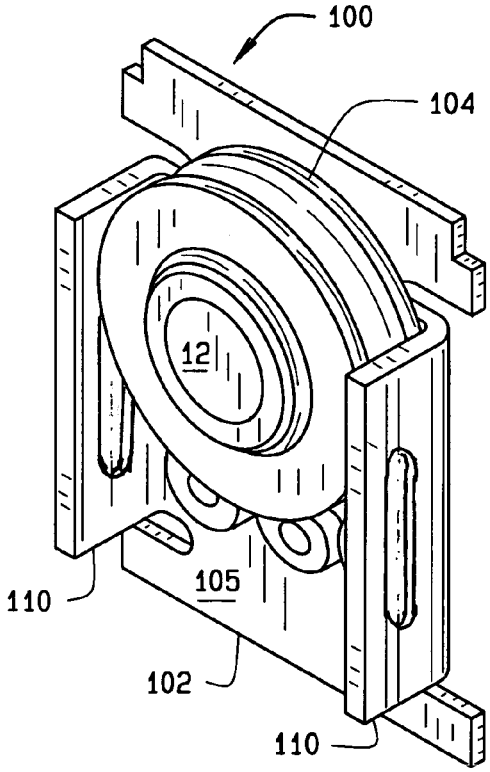
FIG. 9 is a front perspective view of the pulley bracket

The bracket 102 is apertured to receive a stud 112, which is coined or otherwise attached to the bracket 102. The stud 112 receives the pulley 104 which includes a split pair of inner races 114, an outer pulley race 116 and the assembly includes a plurality of balls 120, eleven in number in the embodiment shown, received between the inner and outer races. As shown in FIG. 8, the stud is coined at the front end 130 and the rear end 132 to hold the pulley bracket assembly 100 together. The bracket 102 includes a pair of countersunk openings 103 by which the bracket assembly 100 is operatively attached to a surface, such as the upper surface or the inner side surface of the merchandiser cabinet, by countersunk rivets or bolts (not shown).

As shown in FIGS. 6-9 the sash-line is received by the pulleys 104. In the embodiment shown the periphery 134 of the pulley 104 is spaced from the associated bracket flange 110 a gap distance G where G is substantially less than the diameter of the sash-line, and less than half of the sash-line diameter in the embodiment shown.

It is thought that the functional advantages of this self-closing sliding door assembly have become fully apparent from the foregoing detailed description of parts, but for completeness of disclosure, the installation and operation will be briefly described.

The self-closing, sliding door assembly 10 is comprised essentially of a door riding in a track for movement between open and closed limits, the door 20, 22 being opened against the action of the counterweight 70 attached to the door by a sash-line, and the sash-line being guided and supported by a means that enables the counterweight to be suspended and located along the side of the door rather than at its end.

Figure 4:
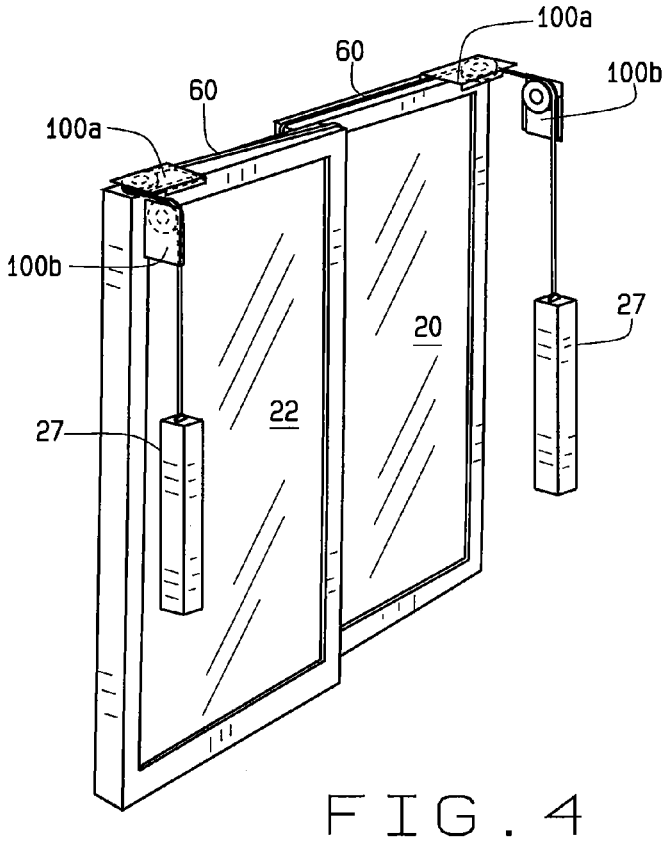
FIG. 4 is an isometric view of the door and counterweight assembly.

As is generally indicated in FIG. 4 and 5 the downward pull exerted by each of the counterweights 70 is translated by an associated sash-line 60 through the pulley bracket assemblies into a substantially horizontal pull applied at the upper innermost corner of the associated door 20 or 22 respectively where the sash-line is connected, as by a screw.

Figure 2:
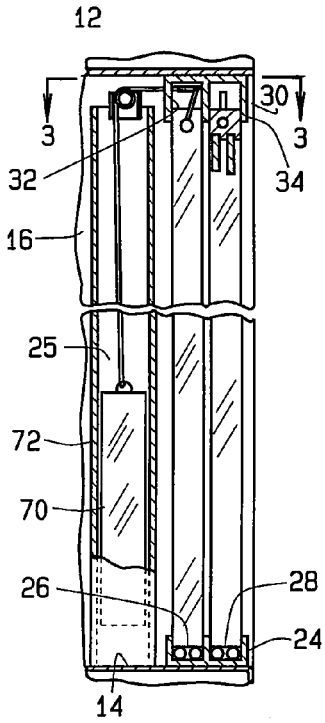
FIG. 2 is enlarged cross-sectional view taken on line 2-2 of FIG. 1.

Referring to door 20 and its counterweight assembly, the gravitational pull exerted by the counterweight 70 causes a constant force to be exerted on the door 20 tending to move the door toward the closed limit in which the end of the door 20 engages the cabinet side wall 18, as is shown in FIG. 5. To open the door 20, a manual push is exerted against the door 20 to overcome the gravitational force exerted by the counterweight 70. The door 20 glides on roller balls, or the like along its associated track channels 24 and to its open limit. When the manual force applied to the door 20 is released, the constant force exerted by the gravitational pull of counterweight 70 returns the door 20 to its closed limit. While the door 20 moves between the open and closed limits, it will be understood that sash-line 60 is passing back and forth over the pulley brackets 100*a* and *b* as the counterweight 70 is alternately raised or lowered within the elongate enclosure 25 (FIG. 2).

The pulley bracket assemblies 100*a* and 100*b* are stationary because they are attached by screws or other suitable means to the cabinet.

Interference of the counterweight 70 with goods stored in the cabinet is prevented by the elongate enclosure 72.

The procedure and mode of operation described above applies also to door 22 when, as indicated in the present embodiment, double doors are provided.

Although the invention has been described by making detailed reference to a single preferred embodiment, such detail is to be understood in an instructive, rather than in any restrictive sense many variations being possible within the scope of the claims hereunto appended.

We claim as our invention:

1. In a self closing, sliding door assembly:

a door for a cabinet slidably mounted for movement in a plane between an open and closed position;

a counterweight offset laterally from the plane of the door;

a first pulley mounted for rotation substantially in a horizontal plane;

a second pulley mounted for rotation substantially in a vertical plane, the first and second pulleys being identical each including a bracket having a base plate mounting the pulley and the base plate having opposed flanges;

a sash-line having opposed ends, one of said ends being attached to the door and the other of said ends being attached to the counterweight, the sash-line extending from one end attached to said door, and in said door plane to said first pulley, around said first pulley and laterally of said door plane to said second pulley and around said second pulley and vertically down to said counterweight, the opposed flanges providing means for guiding and retaining the sash-line on the pulleys during movement of the counterweight.

2. A sliding door assembly as defined in claim 1 wherein:

the bracket flanges are located sufficiently close to the periphery of the pulley to limit the gap therebetween to be less than the diameter of the sash-line.

3. In a self-closing, sliding door assembly:

a cabinet including a side wall;

a door for the cabinet slidably mounted for movement between open and closed positions;

a free falling counterweight offset inwardly of the door;

a first pulley operatively attached to the cabinet for rotation substantially in a horizontal plane;

a second pulley mounted for rotation substantially in a vertical plane;

the first and second pulleys being identical each including a bracket having a base plate mounting the pulley and the base plate having opposed flanges;

a sash line having opposed ends one of said ends being attached to the door and the other of said ends attached to the counterweight and the sash-line passing sequentially over the pulleys, and the sash line extending from one end attached to said door, and in said door plane around said first pulley and laterally of said door plane to said second pulley and around said second pulley and vertically down to said counterweight, the base plate flanges providing means adjacent each pulley for guiding and retaining the sash-line on the pulleys during free falling movement of the counterweight.

4. A self-closing, sliding door assembly as defined in claim 3, wherein:

a gap between the periphery of a pulley and the adjacent flange is sufficiently narrow to prevent the sash-line from passing therethrough.

5. In a self-closing sliding door assembly:

a cabinet including opposed side walls, a pair of doors for the cabinet slidably mounted for movement between open and closed positions, a pair of free falling counterweights offset inwardly of respective doors;

two sets of pulleys assemblies each set including a first pulley operatively attached to the cabinet for rotation substantially in a horizontal plane; and a second pulley operatively attached to the cabinet for rotation substantially in a vertical plane, the first and second pulleys assemblies being identical each including a bracket having a base plate mounting the pulley and the base plate having opposed flanges;

a pair of sash-lines each having opposed ends one of said ends being attached to a respective door and the other of said ends being attached to a respective counterweight, each sash-line passing sequentially over a respective set of pulleys, and each of the sash-lines extending from one end attached to a respective door, and in a door plane around said first pulley and laterally of said door plane to said second pulley and around said second pulley and vertically down to said counterweight, the base plate flanges providing means adjacent each pulley for guiding and retaining the sash-line on the pulleys during movement of the respective counterweight.

* * * * *